US012378837B2

(12) United States Patent
Zonoz et al.

(10) Patent No.: US 12,378,837 B2
(45) Date of Patent: Aug. 5, 2025

(54) BLOWOUT PREVENTER RAM SEALS AND RAM BLOCKS

(71) Applicant: Schlumberger Technology Corporation, Sugar Land, TX (US)

(72) Inventors: Ray Zonoz, Sugar Land, TX (US); Miguel Urrutia, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/725,471

(22) PCT Filed: Mar. 20, 2023

(86) PCT No.: PCT/US2023/015623
§ 371 (c)(1),
(2) Date: Jun. 28, 2024

(87) PCT Pub. No.: WO2023/183224
PCT Pub. Date: Sep. 28, 2023

(65) Prior Publication Data

US 2025/0084718 A1 Mar. 13, 2025

Related U.S. Application Data

(60) Provisional application No. 63/269,949, filed on Mar. 25, 2022.

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/062
See application file for complete search history.

(56) References Cited

U.S. PATENT DOCUMENTS 3,946,806 A * 3/1976 Meynier, III ..... E21B 29/08 251/1.2
4,323,256 A 4/1982 Miyagishima
4,347,898 A 9/1982 Jones
4,398,729 A * 8/1983 Bishop ..... E21B 33/062 251/1.3
5,603,481 A * 2/1997 Parker ..... E21B 33/062 251/1.3
6,158,505 A 12/2000 Araujo
(Continued)

FOREIGN PATENT DOCUMENTS

WO 2012170811 A1 12/2012

*Primary Examiner* — Kipp C Wallace
(74) *Attorney, Agent, or Firm* — Jeffrey D. Frantz

(57) ABSTRACT

A ram assembly of a BOP includes a ram block including a top cavity formed on a top of the ram block, a first side cavity formed on a first side of the ram block, a second side cavity formed on a second side of the ram block, a top seal disposed in the top cavity, a first side packer assembly disposed in the first side cavity, a second side packer assembly disposed in the second side cavity, wherein each of the first side packer assembly and the second side packer assembly includes an upper insert, a lower insert, and an elastomeric body positioned between the upper insert and the lower insert including elastomeric material, and wherein the top seal is disposed behind and extends to a bottom of the elastomeric body of the first and second side packer assemblies.

17 Claims, 7 Drawing Sheets

(56) References Cited

U.S. PATENT DOCUMENTS

| | | | | |
|---|---|---|---|---|
| 9,976,373 | B2 | 5/2018 | Araujo et al. | |
| 9,976,374 | B2 | 5/2018 | Araujo et al. | |
| 12,024,969 | B2 * | 7/2024 | Remington | E21B 33/062 |
| 2006/0021749 | A1 * | 2/2006 | Schaeper | E21B 33/063 166/85.4 |
| 2006/0038147 | A1 | 2/2006 | Urrutia | |
| 2006/0144586 | A1 | 7/2006 | Urrutia | |
| 2013/0062540 | A1 * | 3/2013 | Jurena | E21B 33/062 251/1.3 |
| 2016/0102518 | A1 * | 4/2016 | Araujo | A47G 19/2266 251/1.3 |
| 2017/0145772 | A1 * | 5/2017 | Araujo | E21B 33/063 |
| 2019/0162040 | A1 * | 5/2019 | Threadgill | E21B 33/063 |
| 2021/0156216 | A1 * | 5/2021 | Strankman | E21B 33/063 |
| 2021/0270105 | A1 | 9/2021 | Threadgill | |
| 2021/0355800 | A1 * | 11/2021 | Guidry | E21B 43/2607 |

* cited by examiner

BLOWOUT PREVENTER RAM SEALS AND RAM BLOCKS

CROSS-REFERENCE TO RELATED APPLICATION

This application is a National Stage Entry of International Application No. PCT/US2023/015623, filed on Mar. 20, 2023, which claims priority to U.S. Provisional Patent Application No. 63/269,949, which was filed on Mar. 25, 2022 and is incorporated herein by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A blowout preventer (BOP) stack may be installed on a wellhead to seal and control an oil and gas well during drilling operations. A tubular string may be suspended inside a drilling riser and extend through the BOP stack into the wellhead. During drilling operations, a drilling fluid may be delivered through the tubular string and returned through a bore between the tubular string and a casing of the drilling riser. In the event of a rapid invasion of formation fluid in the bore, commonly known as a "kick," the BOP stack may be actuated to isolate the drilling riser from the wellhead and to control a fluid pressure in the bore, thereby protecting well equipment disposed above the BOP stack.

SUMMARY

According to one or more embodiments of the present disclosure, a ram assembly of a BOP includes: a ram block including: a top cavity formed on a top of the ram block; a first side cavity formed on a first side of the ram block; a second side cavity formed on a second side of the ram block; a top seal disposed in the top cavity; a first side packer assembly disposed in the first side cavity; a second side packer assembly disposed in the second side cavity, wherein each of the first side packer assembly and the second side packer assembly includes: an upper insert; a lower insert; and an elastomeric body positioned between the upper insert and the lower insert including elastomeric material, and wherein the top seal is disposed behind and extends to a bottom of the elastomeric body of the first and second side packer assemblies.

According to one or more embodiments of the present disclosure, a BOP includes: a body surrounding a bore configured to enable fluid flow between a wellhead and a drilling riser; a lower ram block disposed adjacent a first end of the body, wherein the lower ram block is coupled to a first actuator; and an upper ram block disposed adjacent to a second end opposite the first end of the body, wherein the upper ram block is coupled to a second actuator, wherein the lower ram block, the upper ram block, or both, include: a ram block body including: a top cavity formed on a top of the ram block body; a first side cavity formed on a first side of the ram block body; a second side cavity formed on a second side of the ram block body; a top seal disposed in the top cavity; a first side packer assembly disposed in the first side cavity; a second side packer assembly disposed in the second side cavity, wherein each of the first side packer assembly and the second side packer assemblies includes: an upper insert; a lower insert; and an elastomeric body positioned between the upper insert and the lower insert including elastomeric material, wherein the top seal is disposed behind and extends to a bottom of the elastomeric body of the first and second side packer assemblies, and wherein the upper ram block comprises a blade seal that sealingly engages the elastomeric body of the first and second side packer assemblies.

A method according to one or more embodiments of the present disclosure includes: monitoring a well condition of a wellbore; actuating a BOP in response to the well condition being indicative of blowout conditions, wherein the BOP includes: a bore formed therethrough that enables fluid flow between a wellhead and a drilling riser; an upper ram block; and a lower ram block, wherein each of the upper ram block and the lower ram block includes: a ram block body including: a top cavity formed on a top of the ram block body; a first side cavity formed on a first side of the ram block body; a second side cavity formed on a second side of the ram block body; a top seal disposed in the top cavity; a first side packer assembly disposed in the first side cavity; a second side packer assembly disposed in the second side cavity, wherein each of the first side packer assembly and the second side packer assembly includes: an upper insert, a lower insert, and an elastomeric positioned between the upper insert and the lower insert including elastomeric material, wherein a top seal is disposed behind and extends to a bottom of the elastomeric body of the first and second side packer assemblies, wherein the upper ram block includes: an upper blade; and a blade seal that rests below the upper blade, the blade seal sealingly engaging the elastomeric body of the first and second side packer assemblies, and wherein the lower ram block includes a lower blade; and directing the upper ram block and the lower ram block toward one another such that the top seal, the elastomeric body of the first and second side packer assemblies, and the blade seal work together to fully seal the bore and further block the fluid flow from the wellhead to the drilling riser; and a shearing edge of the lower blade passes below a shearing edge of the upper blade to shear a tubular string extending through the bore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein. The figures are not necessarily to scale and certain features and certain views of the figures may be shown exaggerated in scale for purposes of clarification.

DETAILED DESCRIPTION

Figure 1:
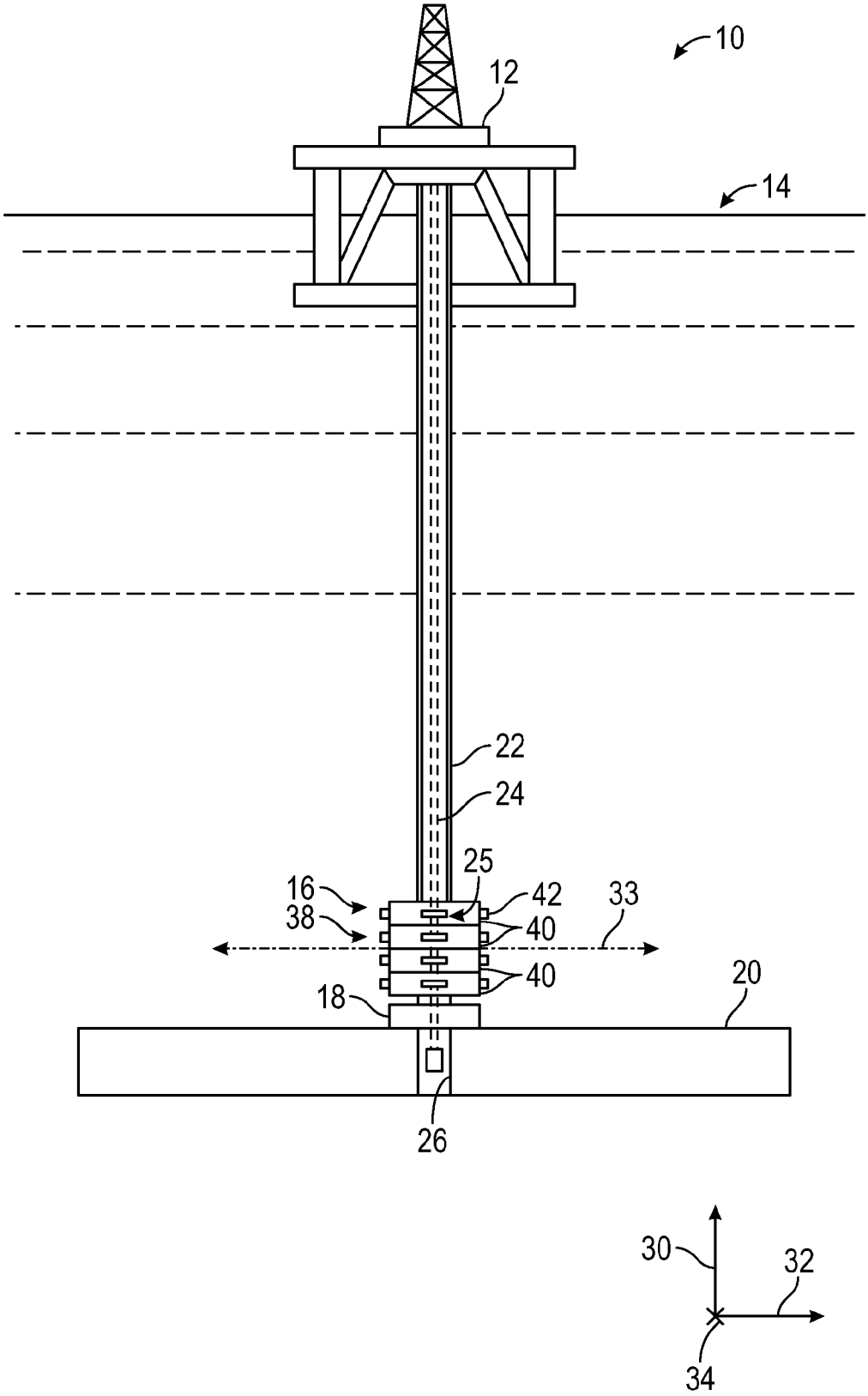
FIG. 1 is a schematic diagram of a drilling system, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure for the sake of convenience, and such terms do not require any particular orientation of the components. Commonly, these terms relate to a reference point at the surface from which drilling operations are initiated as being the top point and the total depth being the lowest point, wherein the well (e.g., wellbore, borehole) is vertical, horizontal, or slanted relative to the surface.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

One or more embodiments of the present disclosure relate to a BOP that may include improved ram seal and/or ram block configurations to enhance a seal formed by the BOP without imparting undue stress or damage to components of the BOP. A BOP may be included at a wellhead to block a fluid from inadvertently flowing from the wellhead to a drilling platform (e.g., through a drilling riser). For example, pressures may fluctuate within a natural reservoir, which may lead to a surge in fluid flow from the wellhead toward the drilling platform when the pressure reaches a threshold value. To block fluid from flowing toward the drilling platform during a kick and/or a blowout condition, the BOP may be actuated to cover a bore in the BOP that couples the wellhead to the drilling riser. In some cases, ram blocks of the BOP are actuated to engage (e.g., contact and/or cut) a tubular string or pipe disposed in the bore.

Specifically, BOP ram blocks are designed to move laterally toward a vertical bore of the BOP to shear or seal off any object located therein. BOP ram blocks may include a ram block body, a top seal, side packer seals, and a blade seal. When opposing ram blocks are in a closed position, the top seal, the side packer seals, and the blade seal of the opposing ram blocks work together to provide full sealing capacity to block fluid from flowing toward the drilling platform during well control operations. A BOP ram block may experience diminished sealing capacity when in use if a contact surface between the top seal and the side packer seals is not sufficiently large, or if one of the side packer seals is not sufficiently retained against the ram block body. Moreover, the BOP ram block may experience undue stress when in use due to excess pressure being exerted on the ram block body. Further, a blade seal resting below an upper blade on the upper ram block may become damaged when in use if a tubular string or other object disposed in the bore of the BOP becomes stuck. Accordingly, there is a need for enhanced sealing capacity for BOP ram blocks during well control operations without imparting undue stress or damage to components of the BOP ram block.

With the foregoing in mind, FIG. 1 is a schematic diagram of a drilling system, according to one or more embodiments of the present disclosure. The drilling system 10 includes a vessel or platform 12 at a surface 14. A BOP stack assembly 16 is mounted to a wellhead 18 at a floor 20 (e.g., a sea floor for offshore operations). A tubular drilling riser 22 extends from the platform 12 to the BOP stack assembly 16. The riser 22 may return drilling fluid or mud to the platform 12 during drilling operations. Downhole operations are carried out by a tubular string 24 (e.g., drill string, production tubing string, or the like) that extends from the platform 12, through the riser 22, through a bore 25 of the BOP stack assembly 16, and into a wellbore 26.

To facilitate discussion, the BOP stack assembly 16 and its components may be described with reference to an axial axis or direction 30, a second axis or direction 32 extending longitudinally along a centerline 33 of the BOP stack assembly 16 (e.g., a longitudinal axis crosswise to the axial axis or direction 30), and a third axis or direction 34 (e.g., a lateral axis crosswise to the axial axis or direction 30 and the second axis or direction 32). As shown, the BOP stack assembly 16 includes a BOP stack 38 having multiple BOPs 40 (e.g., ram BOPs) axially stacked (e.g., along the axial axis 30) relative to one another. As discussed in more detail below, each BOP 40 may include a pair of longitudinally opposed rams and corresponding actuators 42 that actuate and drive the rams toward and away from one another along the second axis 32. Although four BOPs 40 are shown, the BOP stack 38 may include any suitable number of the BOPs 40 (e.g., 1, 2, 3, 4, 5, 6, 7, 8, 9, 10, or more BOPs 40). Additionally, the BOP stack 38 may include any of a variety of different types of rams. For example, in certain embodiments, the BOP stack 38 may include one or more BOPs 40 having opposed shear rams or blades configured to sever the tubular string 24 and seal off the wellbore 26 from the riser 22 and/or one or more BOPs 40 having opposed pipe rams configured to engage the tubular string 24 and to seal the bore 25 (e.g., an annulus around the tubular string 24).

Figure 2:
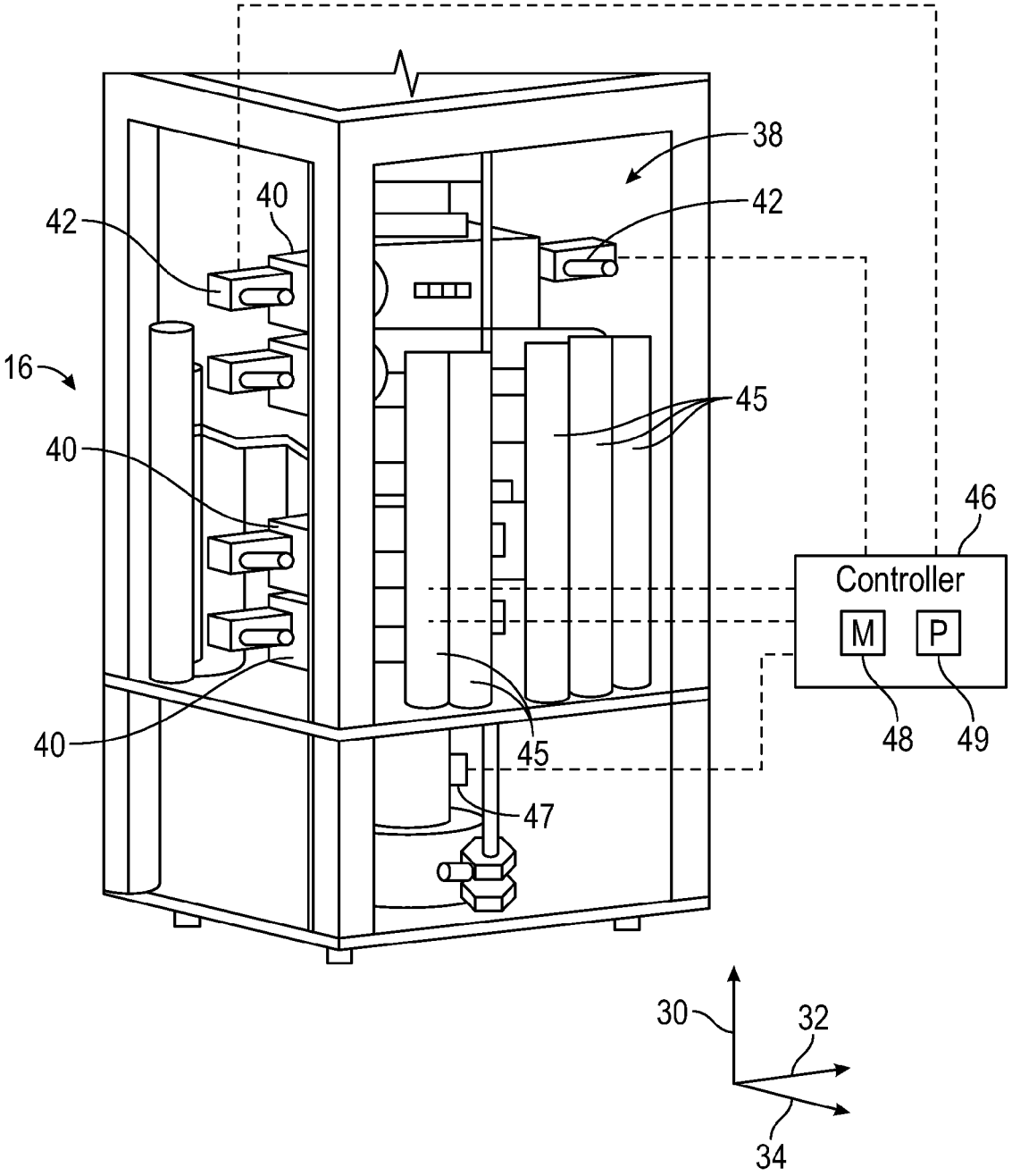
FIG. 2 is a perspective view of a BOP stack assembly that may be used in the drilling system of FIG. 1, according to one or more embodiments of the present disclosure.

FIG. 2 is a perspective view of a BOP stack that may be used in the drilling system of FIG. 1, according to one or more embodiments of the present disclosure. As discussed above, the BOP stack 38 includes multiple BOPs 40 axially stacked (e.g., along the axial axis 30) relative to one another. As shown, the BOP stack 38 also includes one or more accumulators 45 (e.g., hydraulic accumulators, pneumatic accumulators, electric accumulators, etc.). In some embodiments, the accumulators 45 store and/or supply (e.g., via one or more pumps) hydraulic pressure to the actuators 42 that are configured to drive the ram blocks of the BOPs 40. In certain embodiments, the accumulators 45 and/or the actuators 42 may be communicatively coupled to a controller 46. The controller 46 may be configured to send signals to the accumulators 45, the actuators 42, and/or one or more pumps to drive the ram blocks of the BOPs 40 when blowout conditions exist. For example, the controller 46 may receive feedback from one or more sensors 47 (e.g., pressure sensors, temperature sensors, flow sensors, vibration sensors, and/or composition sensors) that may monitor conditions of the wellbore 26 (e.g., a pressure of the fluid in the wellbore 26). The controller 46 may include memory 48 that stores threshold values indicative of blowout conditions. Accordingly, a processor 49 of the controller 46 may send a signal instructing the accumulators 45, the actuators 42, and/or the one or more pumps to drive and/or actuate the ram blocks to a closed position when measured feedback received from the controller 46 meets or exceeds such threshold values.

Figure 3:
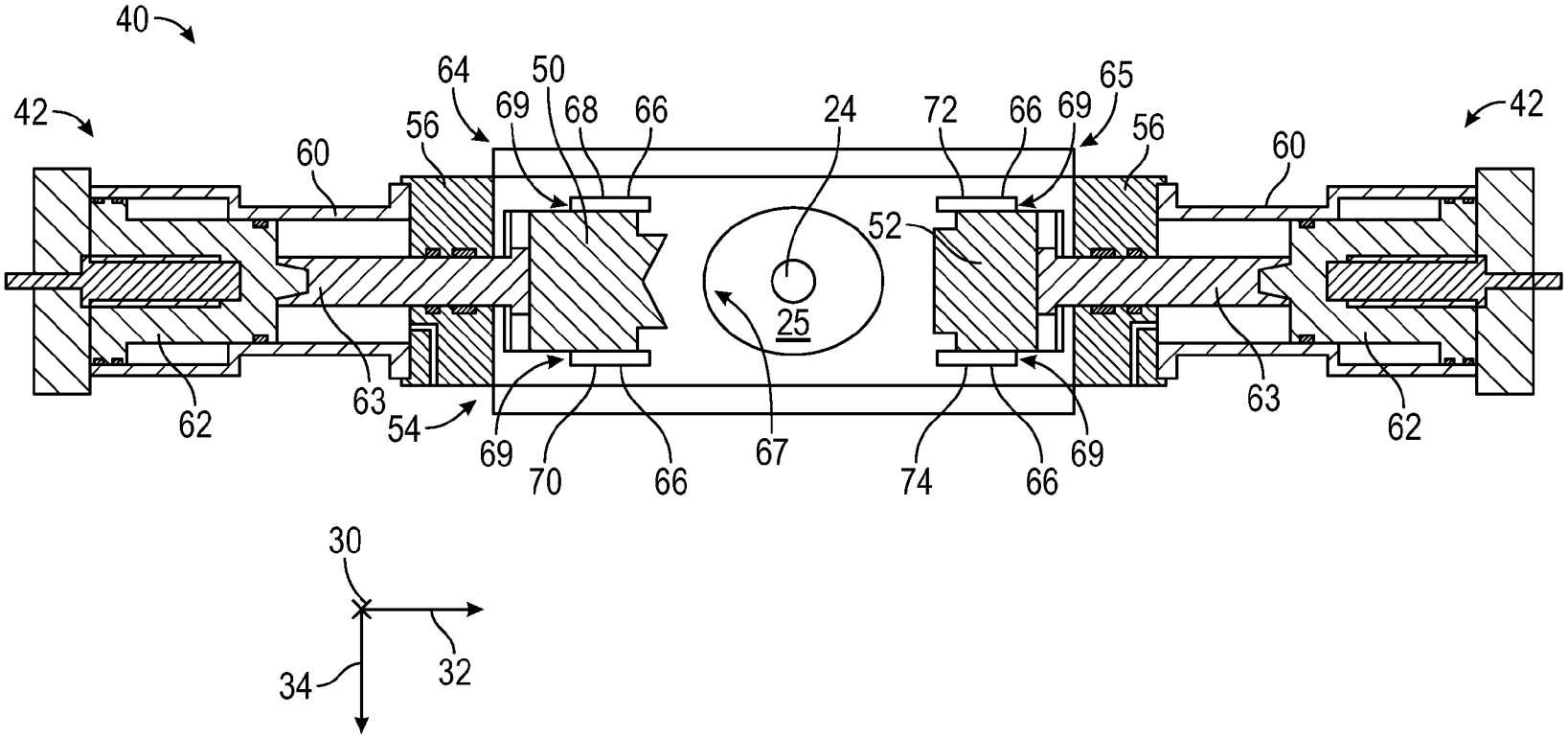
FIG. 3 is a cross-sectional top view of a portion of a BOP of the BOP stack of the BOP stack assembly of FIG. 2, illustrating lower and upper rams in an open position, according to one or more embodiments of the present disclosure.

Referring now to FIG. 3, a cross-sectional top view of a portion of a BOP 40 of the BOP stack 38 of the BOP stack assembly 16 of FIG. 2, according to one or more embodiments of the present disclosure is shown. Specifically, FIG. 3 shows a lower ram block 50 and an upper ram block 52 in an open or default position 54. In the default position 54, the lower ram block 50 and the upper ram block 52 are withdrawn or retracted from the bore 25, do not contact the tubular string 24, and/or do not contact the corresponding opposing ram block 50, 52. As shown, the BOP 40 includes a body 56 (e.g., housing) surrounding the bore 25. The body 56 is generally rectangular in the illustrated embodiment, although the body 56 may have any cross-sectional shape, including any polygonal shape or an annular shape. A plurality of bonnet assemblies 60 are mounted to the body 56 (e.g., via threaded fasteners). In the illustrated embodiment, first and second bonnet assemblies 60 are mounted to diametrically opposite sides of the body 56. Each bonnet assembly 60 supports an actuator 42, which includes a piston 62 and a connecting rod 63. As shown in the illustrated embodiment of FIG. 3, when in the default position 54, the lower ram block 50 is generally adjacent to a first end 64 of the body 56 and the upper ram block 52 is generally adjacent to a second end 65, opposite the first end 64, of the body 56. The actuators 42 may drive the lower and upper ram blocks 50, 52 toward and away from one another along the second axis 32 and through the bore 25 to contact and/or shear the tubular string 24 to seal the bore 25.

The lower and upper ram blocks 50, 52 may each include one or more packer assemblies 66 (e.g., side packer assemblies) that are configured to engage a surface 67 (e.g., annular surface) of the bore 25 to enhance a seal formed by the BOP 40. For example, as shown in the illustrated embodiment of FIG. 3, the lower ram block 50 may include a first side packer assembly 68 and a second side packer assembly 70 positioned on opposite lateral sides of the lower ram block 50. Further, the upper ram block 52 may include a third side packer assembly 72 and a fourth side packer assembly 74 positioned on opposite sides of the upper ram block 52. The side packer assemblies 66 are configured to engage the surface 67 and block fluid from flowing between the surface 67 and the lower and upper ram blocks 50, 52 toward the platform 12 while the BOP 40 is in a closed position. In some embodiments, the side packer assemblies 66 may be configured to move along the second axis 32 with respect to corresponding cavities of the lower and upper ram blocks 50, 52. For example, when the lower and upper ram blocks 50, 52 are moved toward one another to the closed position in which the lower and upper ram blocks 50, 52 seal the bore 25, the first and second side packer assemblies 68, 70 may be configured to engage the third and fourth side packer assemblies 72, 74, respectively, which may cause the side packer assemblies 66 to move within the respective cavities. Because a portion of the side packer assemblies 66 may include a resilient material (e.g., compressible or elastic material), the side packer assemblies 66 may compress longitudinally and expand laterally outward to contact the surface 67 of the bore 25 to enhance a seal of the bore 25 formed by the BOP 40.

Figure 4:
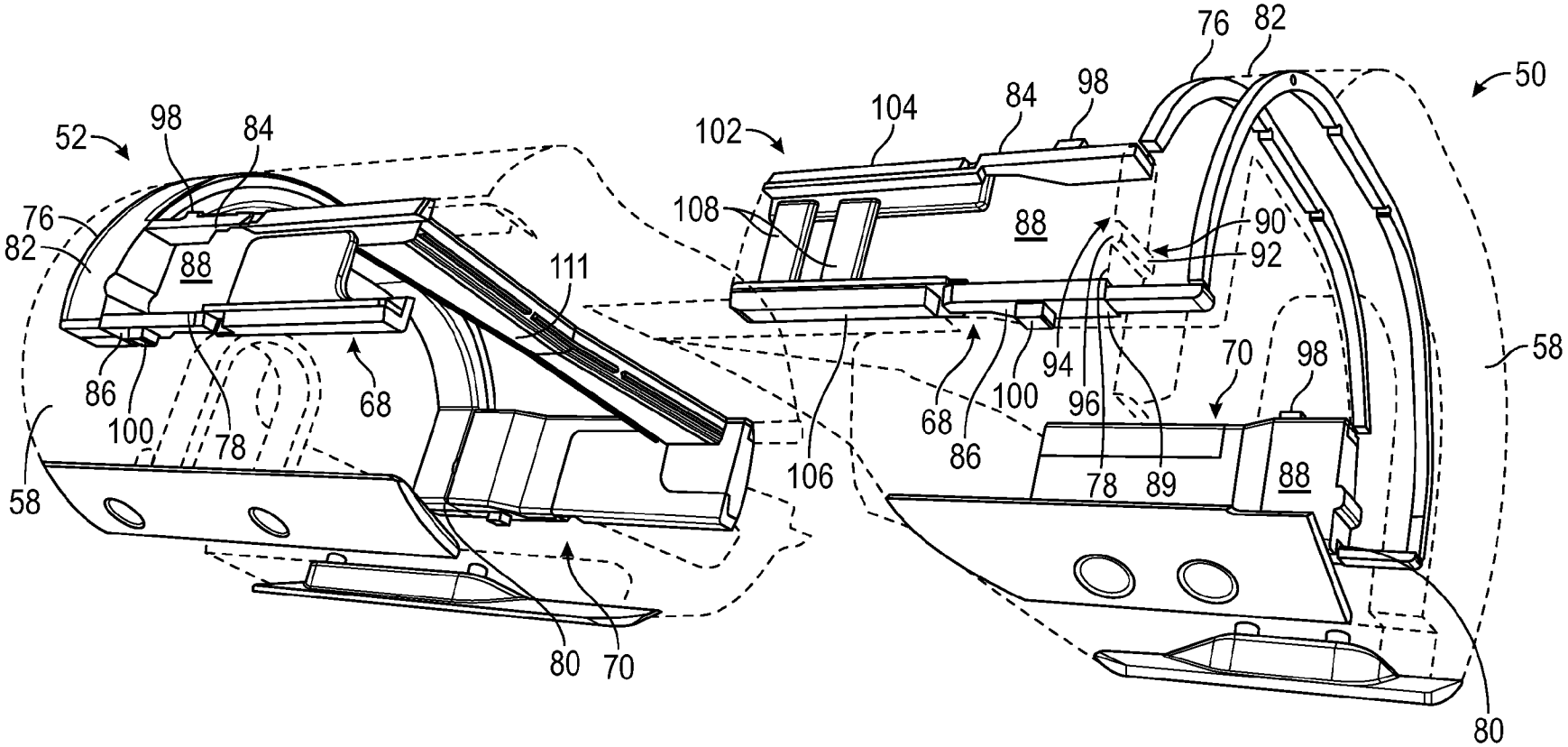
FIG. 4 is a partial detailed view of lower and upper ram blocks, which may be used in the BOP stack of the BOP stack assembly of FIG. 2, according to one or more embodiments of the present disclosure.
Figure 5:
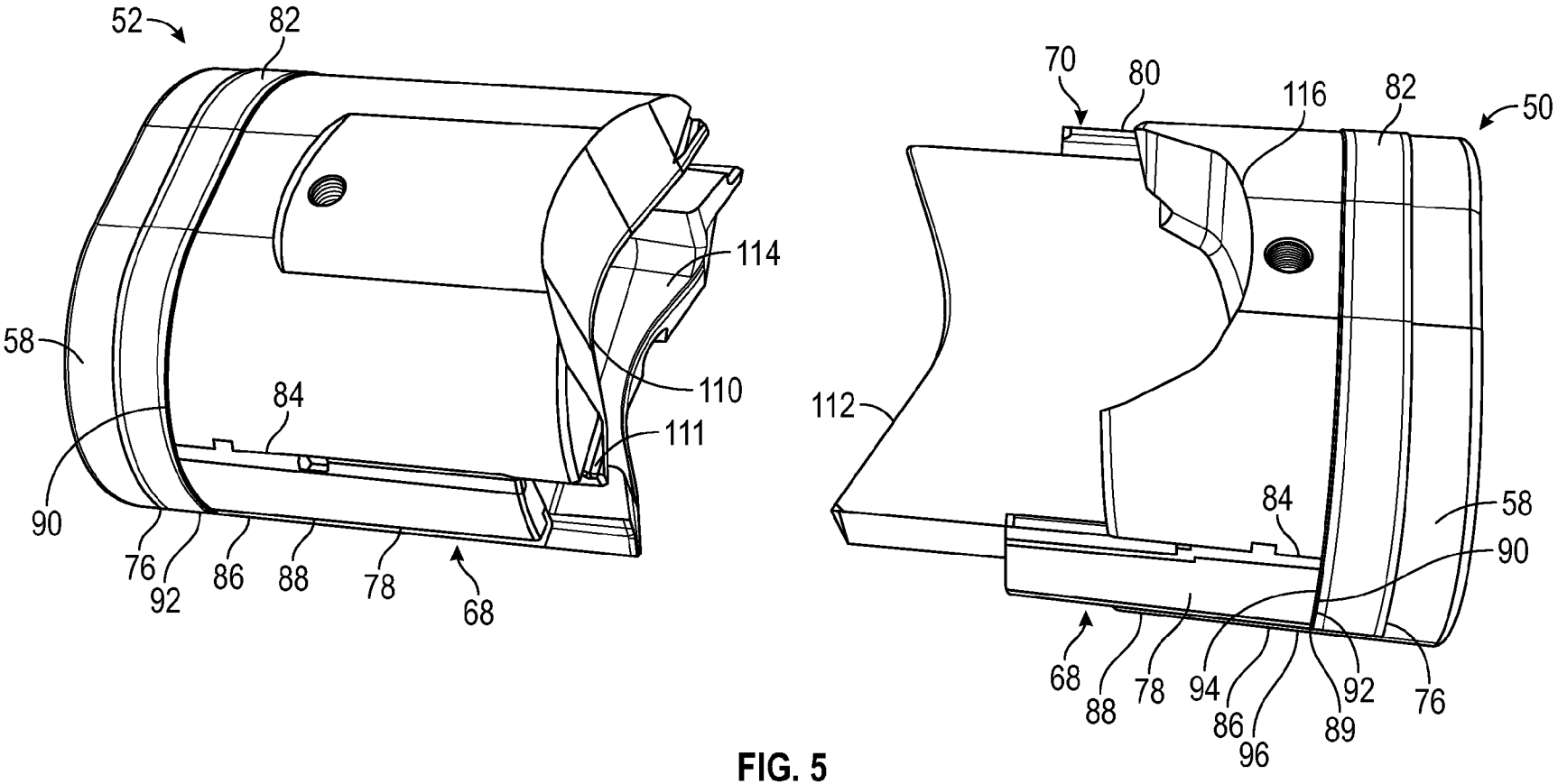
FIG. 5 is a perspective view of lower and upper ram blocks according to one or more embodiments of the present disclosure.
Figure 6:
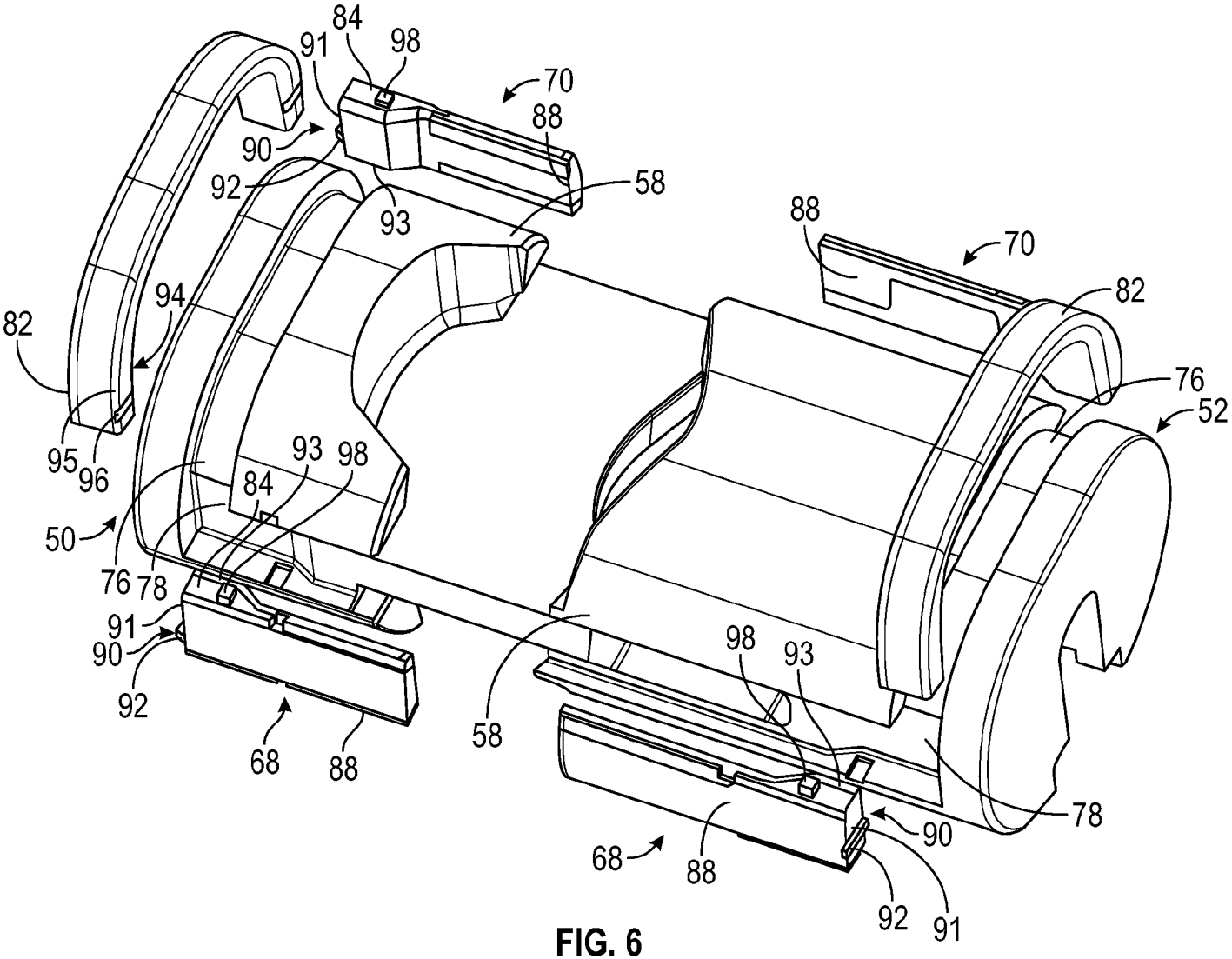
FIG. 6 is a an exploded perspective view of lower and upper ram blocks according to one or more embodiments of the present disclosure.

Referring now to FIG. 4, a partial detailed view of the lower and upper ram blocks 50, 52, which may be used in the BOP stack 38 of the BOP stack assembly 16 of FIG. 2, is shown according to one or more embodiments of the present disclosure. Further, FIG. 5 shows a perspective view of the lower and upper ram blocks 50, 52 according to one or more embodiments of the present disclosure, and FIG. 6 shows an exploded perspective view of the lower and upper ram blocks 50, 52 according to one or more embodiments of the present disclosure. As shown in FIGS. 4, 5, and 6, the ram block body 58 of the lower and upper ram blocks 50, 52 may include a top cavity 76 formed on a top of the ram block body 58, a first side cavity 78 formed on a first side of the ram block body 58, and a second side cavity 80 formed on a second side of the ram block body 58, according to one or more embodiments of the present disclosure. As shown in FIGS. 4, 5, and 6, a top seal 82 may be disposed in the top cavity 76 of the ram block body 58, a first side packer assembly 68 may be disposed in the first side cavity 78 of the ram block body 58, and a second side packer assembly 70 may be disposed in the second side cavity 80 of the ram block body 58, according to one or more embodiments of the present disclosure.

As best shown in FIG. 4, each of the first side packer assembly 68 and the second side packer assembly 70 may include an upper insert 84, a lower insert 86, and an elastomeric body 88 or resilient material positioned between the upper insert 84 and the lower insert 86. According to one or more embodiments of the present disclosure, the elastomeric body 88 may include an elastomeric material, for example. As shown in FIGS. 4 and 5, according to one or more embodiments of the present disclosure, the top seal 82 is disposed behind and extends to a bottom 89 of the elastomeric body 88 of the first side packer assembly 68 and the second side packer assembly 70. As best shown in FIG. 6, the elastomeric body 88 includes a back end 90 having an orientation tab 92 surrounded by a flat surface 91, and the top seal 82 includes a front end 94 having a recess 96 surrounded by a flat surface 95, according to one or more embodiments of the present disclosure. As shown in FIGS. 4 and 5, the orientation tab 92 of the elastomeric body 88 is configured to mate with the recess 96 of the top seal 82 as the flat surface 91 of the back end 90 of the elastomeric body 88 interfaces with the flat surface 95 of the front end 94 of the top seal 82, according to one or more embodiments of the present disclosure. Due to this configuration, the elastomeric body 88 and the top seal 82 may be properly oriented during assembly. Moreover, because the top seal 82 is disposed behind and extends to the bottom 89 of the elastomeric body 88 of the first side packer assembly 68 and the second side packer assembly 70, and because the flat surface 91 of the back end 90 of the elastomeric body 88 interfaces with the flat surface 95 of the front end 94 of the top seal 82, an increased contact surface area between the elastomeric bodies 88 of the first and second side packer assemblies 68, 70 and the top seal 82 may be realized. Advantageously, this increased contact surface area may enhance the energizing and sealing capability of the elastomeric bodies 88 of the first and second side packer assemblies 68, 70, according to one or more embodiments of the present disclosure.

As best shown in FIG. 4, the upper insert 84 of each of the first side packer assembly 68 and the second side packer assembly 70 includes an upper tab 98, and the lower insert 86 of each of the first side packer assembly 68 and the second side packer assembly 70 includes a lower tab 100, according to one or more embodiments of the present disclosure. Each of the upper tab 98 and the lower tab 100 of one or more embodiments of the present disclosure assumes a tab volume that is between 400% and 500% larger than upper and lower tabs of prior side packer assemblies. For example, each of the upper tab 98 and the lower tab 100 of one or more embodiments of the present disclosure may assume a tab volume in a range of about 0.08 cubic inches to about 0.10 cubic inches, yielding a full assembly tab volume in a range of about 0.32 cubic inches to about 0.40 cubic inches. As facilitated by the increase in tab volume of the upper tab 98 and the lower tab 100, while the lower and upper ram blocks 50, 52 are in the closed position or in the open or default position 54, the upper tab 98 and the lower tab 100 of each of the first and second side packer assemblies 68, 70 cooperatively and vertically retain the first and second side packer assemblies 68, 70 against the ram block body 58, according to one or more embodiments of the present disclosure. Due to this functionality of the upper tab 98 and the lower tab 100, the first and second side packer assemblies 68, 70 are able to lock with the ram block body 58 such that the first and second side packer assemblies 68, 70 and the ram block body 58 are able to move together as an integral unit during the closing and opening actions of the BOP 40 without either of the first or second side packer assemblies 68, 70 being left behind in the bore 25, for example.

As best shown in FIG. 4, each of the first side packer assembly 68 and the second side packer assembly 70 of the lower ram block 50 includes a bridging insert 102 connected to the upper insert 84 and the lower insert 86 of the lower ram block 50, according to one or more embodiments of the present disclosure. The bridging insert 102 according to one or more embodiments of the present disclosure includes a first side rail 104 connected to the upper insert 84 of the lower ram block 50, and a second side rail 106 connected to the lower insert 86 of the lower ram block 50, as shown in FIG. 4, for example. According to one or more embodiments of the present disclosure, the first side rail 104 and the second side rail 106 are spaced apart and run parallel to each other. The bridging insert 102 according to one or more embodiments of the present disclosure also includes two rungs 108 disposed between the first side rail 104 and the second side rail 106. According to one or more embodiments of the present disclosure, the two rungs 108 of the bridging insert 102 are spaced apart and run parallel to each other. According to one or more embodiments of the present disclosure, the two rungs 108 are oriented perpendicular to the first side rail 104 and the second side rail 106. While two rungs 108 are shown in FIG. 4, the bridging insert 102 may include more than two rungs 108 without departing from the scope of the present disclosure. During operation, closing and opening the BOP 40 creates increased pressure on the ram block body 58. Advantageously, including the bridging insert 102 to the first and second side packer assemblies 68 of the lower ram block 50 in accordance with one or more embodiments of the present disclosure, reduces the stress and plastic deformation experienced by the ram block body 58 by up to about 80% during operation, thereby increasing the useful life of the ram block body 58.

As best shown in FIG. 5, the upper ram block 52 includes an upper blade 110, and the lower ram block 50 includes a lower blade 112, according to one or more embodiments of the present disclosure. The lower blade 112 may assume a "V" shape having an acute angle between about 10 degrees and about 30 degrees, for example, according to one or more embodiments of the present disclosure. During a shearing action of the BOP 40 (i.e., when the lower ram block 50 and the upper ram block 52 are driven toward each other), a shearing edge of the lower blade 112 passes below a shearing edge of the upper blade 110, according to one or more embodiments of the present disclosure. As best shown in FIGS. 4 and 5, the upper ram block 52 also includes a blade seal 111 that rests below the upper blade 110 and sealingly engages the first and second side packer assemblies 68, 70, according to one or more embodiments of the present disclosure. When the lower ram block 50 and the upper ram block 52 are in the closed position, the blade seal 111 also sealingly engages the lower blade 112, according to one or more embodiments of the present disclosure. When the lower ram block 50 and the upper ram block 52 are in a closed position, the top seal 82, the elastomer bodies 88 of the first and second side packer assemblies 68, 70, and the blade seal 111 of the lower and upper ram blocks 50, 52 work together to provide full sealing capacity to block fluid from flowing toward the drilling platform during well control operations.

As shown in FIG. 5, the upper ram block 52 may also include a foldover shoulder 114, according to one or more embodiments of the present disclosure. As shown in FIG. 5, for example, the foldover shoulder 114 is disposed beneath the upper blade 110 and the blade seal 111 of the upper ram block 52, according to one or more embodiments of the present disclosure. During a shearing action of the BOP 40 (i.e., when the lower ram block 50 and the upper ram block 52 are driven toward each other), the shearing edge of the lower blade 112 passes above the foldover shoulder 114 of the upper ram block 52, and the tubular string 24 hits the foldover shoulder 114 of the upper ram block 52 and does not contact the blade seal 111. As such, the blade seal 111 of the upper ram block 52 is not damaged by the tubular string 24 during the shearing action of the BOP 40, thereby prolonging the useful life of the upper ram block 52, according to one or more embodiments of the present disclosure. As further shown in FIG. 5, the top of the ram block body 58 of the lower ram block 50 includes a fish pocket 116, according to one or more embodiments of the present disclosure. After the shearing action of the BOP 40, the fish pocket 116 provides a space to accommodate a sheared end of a tubular string 24, according to one or more embodiments of the present disclosure.

As best shown in FIG. 6, the elastomeric body 88 of each of the first and second side packer assemblies 68, 70 may include additional elastomeric material disposed at a side end 93 of the elastomeric body 88, and a depth of the first and second side cavities 78, 80 may be increased to accommodate this additional elastomeric material disposed at the side end 93 of the elastomeric body 88, according to one or more embodiments of the present disclosure. For example, when compared to the elastomer body of prior side packer assemblies, according to one or more embodiments of the present disclosure, each elastomeric body 88 of each of the first and second side packer assemblies 68, 70 may include a range of about 2.0 cubic inches to about 2.25 cubic inches of additional elastomeric material disposed at the side end 93 of the elastomeric body 88, yielding a total range of about 8.0 cubic inches to about 9.0 cubic inches of additional elastomeric material amongst the two sets of first and second side packer assemblies 68, 70 (i.e., one set of first and second side packer assemblies 68, 70 for each of the lower ram block 50 and the upper ram block 52, for a total of four side packer assemblies). With this configuration, the first and second packer assemblies 68, 70 may be fully contained within the corresponding first and second side cavities 78, 80, further ensuring that the first and second side packer assemblies 68, 70 and the ram block body 58 are able to move together as an integral unit during the closing and opening actions of the BOP 40 without the first and second packer assemblies 68, 70 horizontally sliding within the first and second side cavities 78, 80 along the longitudinal axis 32.

Figure 7:
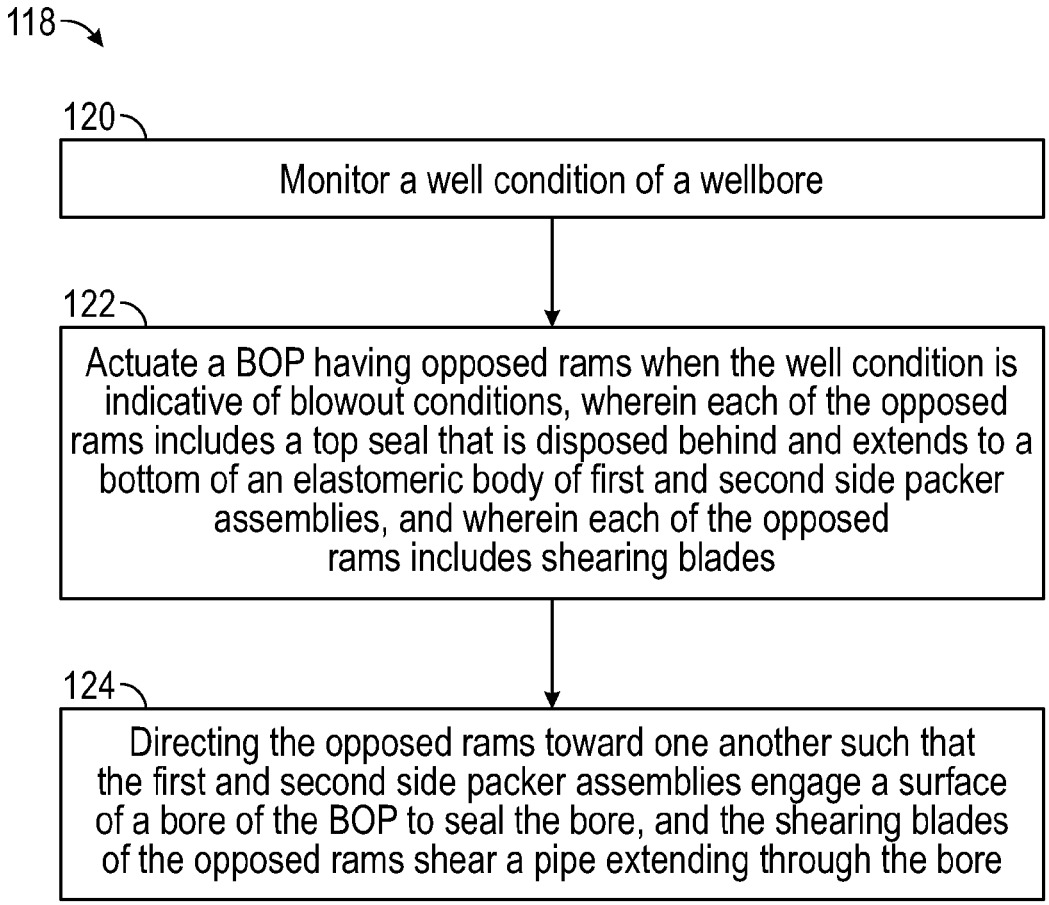
FIG. 7 is a flow chart of a process for using the lower and upper ram blocks of FIGS. 4, 5, and 6 according to one or more embodiments of the present disclosure.

Referring now to FIG. 7, a flow chart of a process 118 for using the lower and upper ram blocks 50, 52 of FIGS. 4, 5, and 6 is shown, according to one or more embodiments of the present disclosure. For example, at step 120, the controller 46 may be configured to monitor a condition (e.g., a fluid pressure, a fluid temperature, a fluid flow rate, or another suitable operating parameter) of the wellbore 26. According to one or more embodiments of the present disclosure, the tubular string 24 is disposed into the wellbore 26, and thus, may pass through the bore 25 of the BOP 40. As discussed above, in one or more embodiments of the present disclosure, the bore 25 is sealed to block a flow of fluid from the wellbore 26 toward the platform 12. For example the wellbore 26 may experience a relatively high pressure (e.g., a kick or blowout conditions), which may ultimately result in inadvertent flow of fluid from the wellbore 26 toward the platform 12. As such, the controller 46 may receive feedback from the one or more sensors 47 and process the feedback to determine whether to seal the bore 25 with the BOP 40.

When the controller 46 determines that the bore 25 should be sealed (e.g., the wellbore 26 is experiencing blowout conditions), the controller 46 may send one or more signals to actuate the BOP 40, as shown at step 122. As discussed above, the lower and upper ram blocks 50, 52 include a top seal 82 that is disposed behind and extends to a bottom 89 of an elastomeric body 88 of the first and second side packer assemblies 68, 70, each of the lower and upper ram blocks 50, 52 includes shearing blades 112, 110, and the upper ram block 52 includes a blade seal 111 that rests below the upper shearing blade 110 and sealingly engages the elastomeric body 88 of the first and second side packer assemblies 68, 70. At step 124, the lower and upper ram blocks 50, 52 are moved toward one another such that the top seal 82, the elastomeric bodies 88 of the first and second side packer assemblies 68, 70, and the blade seal 111 of one or both of the opposed ram blocks 50, 52 work together to fully seal the bore 25 of the BOP 40, and the shearing blades 112, 110 of the opposed ram blocks 50, 52 shear a tubular string 24 extending through the bore 25.

Language of degree used herein, such as the terms "approximately," "about," "generally," "substantially," and "fully" as used herein represent a value, amount, or characteristic close to the stated value, amount, or characteristic that still performs a desired function or achieves a desired result. For example, the terms "approximately," "about," "generally," "substantially," and "fully" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree. As another example, in certain embodiments, the term "fully" refers to a value, amount, or characteristic equal to 100%, or may refer to an amount that is within less than 10% of, within less than 5% of, within less than 1% of, within less than 0.1% of, and/or within less than 0.01% of 100%. Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A ram assembly of a blowout preventer ("BOP") comprising:

a ram block comprising:

a top cavity formed on a top of the ram block;

a first side cavity formed on a first side of the ram block;

a second side cavity formed on a second side of the ram block;

a top seal disposed in the top cavity;

a first side packer assembly disposed in the first side cavity;

a second side packer assembly disposed in the second side cavity, wherein each of the first side packer assembly and the second side packer assembly comprises:

an upper insert;

a lower insert; and an elastomeric body positioned between the upper insert and the lower insert comprising elastomeric material, wherein the top seal is disposed behind and extends to a bottom of the elastomeric body of the first and second side packer assemblies, wherein the elastomeric body comprises a back end having an orientation tab surrounded by a flat surface, wherein the top seal comprises a front end having a recess surrounded by a flat surface, and wherein the orientation tab of the elastomeric body is configured to mate with the recess of the top seal as the flat surface of the back end of the elastomeric body interfaces with the flat surface of the front end of the top seal.

2. The ram assembly of claim 1, wherein the upper insert comprises an upper tab, wherein the lower insert comprises a lower tab, and wherein the upper tab and the lower tab of each of the first and second side packer assemblies cooperatively and vertically retain the first and second side packer assemblies against the ram block.

3. The ram assembly of claim 1, wherein each of the first side packer assembly and the second side packer assembly further comprises a bridging insert connected to the upper insert and the lower insert.

4. The ram assembly of claim 3, wherein the bridging insert comprises:

a first side rail connected to the upper insert;

a second side rail connected to the lower insert, wherein the first side rail and the second side rail are spaced apart and run parallel to each other; and two rungs disposed between the first side rail and the second side rail, wherein the two rungs are spaced apart and run parallel to each other, and wherein the two rungs are oriented perpendicular to the first side rail and the second side rail.

5. A blowout preventer ("BOP"), comprising:

a body surrounding a bore configured to enable fluid flow between a wellhead and a drilling riser;

a lower ram block disposed adjacent a first end of the body, wherein the lower ram is block coupled to a first actuator; and an upper ram block disposed adjacent to a second end opposite the first end of the body, wherein the upper ram block is coupled to a second actuator, wherein the lower ram block, the upper ram block, or both, comprise:

a ram block body comprising:

a top cavity formed on a top of the ram block body;

a first side cavity formed on a first side of the ram block body;

a second side cavity formed on a second side of the ram block body;

a top seal disposed in the top cavity;

a first side packer assembly disposed in the first side cavity;

a second side packer assembly disposed in the second side cavity, wherein each of the first side packer assembly and the second side packer assembly comprises:

an upper insert;

a lower insert; and an elastomeric body positioned between the upper insert and the lower insert comprising elastomeric material, wherein the top seal is disposed behind and extends to a bottom of the elastomeric body of the first and second side packer assemblies, wherein the upper ram block comprises a blade seal that sealingly engages the elastomeric body of the first and second side packer assemblies, wherein the elastomeric body comprises a back end having an orientation tab surrounded by a flat surface, wherein the top seal comprises a front end having a recess surrounded by a flat surface, and wherein the orientation tab of the elastomeric body is configured to mate with the recess of the top seal as the flat surface of the back end of the elastomeric body interfaces with the flat surface of the front end of the top seal.

6. The BOP of claim 5, wherein the upper insert comprises an upper tab, wherein the lower insert comprises a lower tab, and wherein the upper tab and the lower tab of each of the first and second side packer assemblies cooperatively and vertically retain the first and second side packer assemblies against the ram block body.

7. The BOP of claim 5, wherein each of the first side packer assembly and the second side packer assembly of the lower ram further comprises a bridging insert connected to the upper insert and the lower insert of the lower ram block.

8. The BOP of claim 7, wherein the bridging insert comprises:

a first side rail connected to the upper insert of the lower ram block;

a second side rail connected to the lower insert of the lower ram block, wherein the first side rail and the second side rail are spaced apart and run parallel to each other; and two rungs disposed between the first side rail and the second side rail, wherein the two rungs are spaced apart and run parallel to each other, and wherein the two rungs are oriented perpendicular to the first side rail and the second side rail.

9. The BOP of claim 5, wherein the upper ram block further comprises an upper blade, wherein the lower ram block comprises a lower blade, and wherein a shearing edge of the lower blade passes below a shearing edge of the upper blade during a shearing action of the BOP system.

10. The BOP of claim 9, wherein the blade seal of the upper ram block rests below the upper blade, wherein the upper ram block further comprises a foldover shoulder disposed beneath the upper blade and the blade seal, and wherein, during the shearing action of the BOP system, the shearing edge of the lower blade passes above the foldover shoulder of the upper ram block.

11. The BOP of claim 9, wherein the top of the ram block body of the lower ram block further comprises a fish pocket.

12. The BOP of claim 10, wherein the top of the ram block body of the lower ram block further comprises a fish pocket, and wherein, after the shearing action of the BOP, the fish pocket provides a space to accommodate a sheared end of a tubular string.

13. A method, comprising:

monitoring a well condition of a wellbore;

actuating a blowout preventer ("BOP") in response to the well condition being indicative of blowout conditions, wherein the BOP comprises: a bore formed therethrough that enables fluid flow between a wellhead and a drilling riser; an upper ram block; and a lower ram block, wherein each of the upper ram block and the lower ram block comprises:

a ram block body comprising:

a top cavity formed on a top of the ram block body;

a first side cavity formed on a first side of the ram block body;

a second side cavity formed on a second side of the ram block body;

a top seal disposed in the top cavity;

a first side packer assembly disposed in the first side cavity;

a second side packer assembly disposed in the second side cavity, wherein each of the first side packer assembly and the second side packer assembly comprises:

an upper insert;

a lower insert; and an elastomeric body positioned between the upper insert and the lower insert comprising elastomeric material, wherein the top seal is disposed behind and extends to a bottom of the elastomeric body of the first and second side packer assemblies, wherein the upper ram block comprises an upper blade; and wherein the lower ram block comprises a lower blade; and directing the upper ram block and the lower ram block toward one another such that a shearing edge of the lower blade passes below a shearing edge of the upper blade to shear a tubular string extending through the bore, wherein each of the first side packer assembly and the second side packer assembly of the lower ram block further comprises a bridging insert connected to the upper insert and the lower insert of the lower ram block, and wherein the bridging insert comprises:

a first side rail connected to the upper insert of the lower ram block;

a second side rail connected to the lower insert of the lower ram block, wherein the first side rail and the second side rail are spaced apart and run parallel to each other; and two rungs disposed between the first side rail and the second side rail, wherein the two rungs are spaced apart and run parallel to each other, and wherein the two rungs are oriented perpendicular to the first side rail and the second side rail.

14. The method of claim 13, further comprising: cooperatively and vertically retaining the first and second side packer assemblies against the ram block body.

15. The method of claim 13, wherein the upper ram block further comprises a blade seal that rests below the upper blade, the blade seal sealingly engaging the elastomeric body of the first and second side packer assemblies, wherein the upper ram block further comprises a foldover shoulder disposed beneath the upper blade and the blade seal, and wherein, during the directing step, the shearing edge of the lower blade passes above the foldover shoulder of the upper ram block, and the tubular string hits the foldover shoulder and does not contact the blade seal.

16. The method of claim 15, wherein the top of the ram block body of the lower ram block further comprises a fish pocket, the method further comprising accommodating a sheared end of the tubular string using the fish pocket.

17. The method of claim 15, wherein the upper ram block and the lower ram block are further directed toward one another such that the top seal, the elastomeric body of the first and second side packer assemblies, and the blade seal work together to fully seal the bore and further block the fluid flow from the wellhead to the drilling riser.

* * * * *